United States Patent [19]

Kolle

[11] Patent Number: 4,863,220

[45] Date of Patent: Sep. 5, 1989

[54] HIGHLY RELIABLE METHOD OF RAPIDLY GENERATING PRESSURE PULSES FOR DEMOLITION OF ROCK

[75] Inventor: Jack J. Kolle, Seattle, Wash.

[73] Assignee: The United States of America as represented by the Secretary of the Air Force, Washington, D.C.

[21] Appl. No.: 287,195

[22] Filed: Dec. 19, 1988

[51] Int. Cl.[4] ..... E21C 37/00

[52] U.S. Cl. ..... 299/16; 102/329; 137/1; 137/613

[58] Field of Search ..... 137/1, 624.11, 624.14, 137/613, 14; 91/447; 299/16, 13, 20, 21; 102/329, 330; 175/67; 166/177, 249, 308

[56] References Cited

U.S. PATENT DOCUMENTS

| | | | |
|---|---|---|---|
| 2,650,615 | 9/1953 | Nesbam | 137/624.14 |
| 2,672,129 | 3/1954 | Fischer | 137/624.14 X |
| 2,901,977 | 9/1959 | Synder | 91/442 |
| 3,431,934 | 3/1969 | Riordan | 137/624.14 X |
| 4,187,764 | 2/1980 | Cho | 91/442 |
| 4,246,921 | 1/1981 | Beccaria et al. | 137/102 |
| 4,669,783 | 6/1987 | Kolle | 296/16 |

*Primary Examiner*—Alan Cohan

*Attorney, Agent, or Firm*—Robert L. Nathans; Donald J. Singer

[57] ABSTRACT

Providing a fluid pressure pulse generator having a fluid inlet chamber communicating with an accumulator via a movable ball positioned within the inlet chamber, a narrow fluid passageway bypassing the ball, an outlet chamber coupled to a valve seat for preventing communication between the outlet chamber and the accumulator when the movable ball assumes a first position against the valve seat and for permitting the outlet chamber to communicate with the accumulator when the ball is separated from the valve seat in a second position, introducing fluid within the fluid inlet chamber causing the ball to assume the first position and for causing the fluid to flow through the passageway into the accumulator until fluid pressure is very high; and thereafter rapidly reducing fluid pressure within the inlet chamber to cause the ball to assume the second position for in turn causing high impulse ejection of fluid from the accumulator into the outlet chamber.

25 Claims, 1 Drawing Sheet

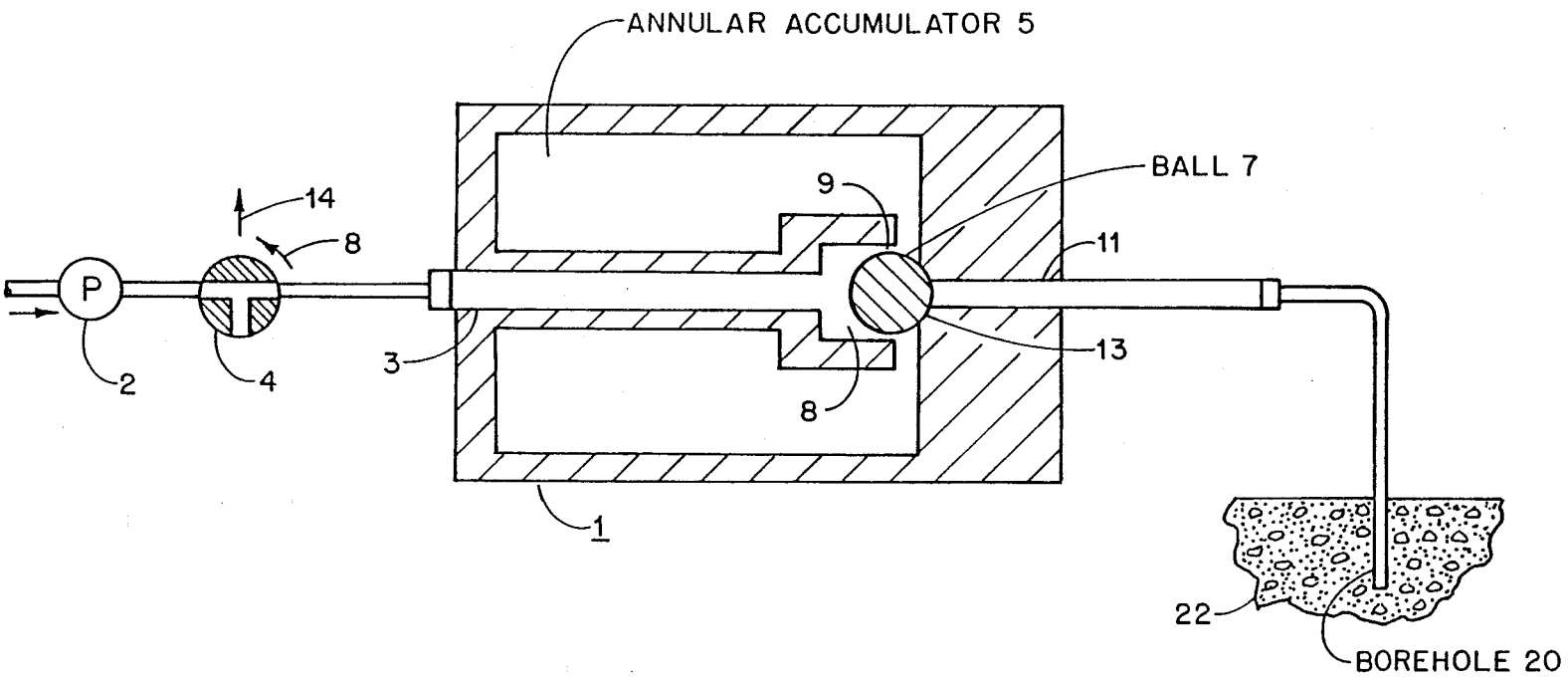
ANNULAR ACCUMULATOR 5
BALL 7
11
13
9
8
1
3
14
8
4
2
P
22
BOREHOLE 20

HIGHLY RELIABLE METHOD OF RAPIDLY GENERATING PRESSURE PULSES FOR DEMOLITION OF ROCK

STATEMENT OF GOVERNMENT INTEREST

The invention described herein may be manufactured and used by or for the Government for governmental purposes without the payment of any royalty thereon.

BACKGROUND OF THE INVENTION

The present invention relates to the field of generating pressure pulses and more particularly a method of generating and utilizing such pulses for the demolition of rock formations and the like. It is desirable to provide for the generation of repeated short rise time pressure pulses from a hydraulic accumulator. It is known to build up very high pressure of water within an accumulator and to cause such high pressure to rupture the disk which very abruptly releases the pressure from the accumulator. However, the use of such a rupture disk has the disadvantage that the disk is destroyed, and the replacement of the ruptured disk is time consuming and costly. It is desirable to eliminate the ruptured disk, enabling a rapid succession of pulses to be produced, which is highly effective in fragmenting rock for excavation purposes. It is also deemed desirable to provide a high pressure pulse generator whereby pressurization of the accumulator and discharge of the accumulator may be accomplished through the use of only one moving part. This results in simplicity and reliability, particularly where very high pressures are employed, which tend to produce wear and erosion of the parts of the pulse generator.

SUMMARY OF THE INVENTION

In accordance with a preferred embodiment of the invention, water is pumped into an annular accumulator chamber by means of a high pressure pump until the pressure in the accumulator is in the neighborhood of about 60,000 psi. The water from the pump passes through a conventional three way valve and around a ball located in the input chamber and into the accumulator. At this time the ball is seated within a valve seat which prevents the outlet tube of the pulse generator from communicating with the accumulator, thereby to enable the pressure to build up therein. The high pressure output pulse is produced by actuating the three way valve to cause the ball to be shifted from a first position against the valve seat into a second position Which enables the discharge of a high pressure output pulse from the accumulator into the outlet tube.

Other objects, features and advantages of the present invention will become apparent upon study of the following detailed description taken in conjunction with the sole Figure which illustrates the apparatus utilized to practice the invention in partial cross section.

DETAILED DESCRIPTION OF THE PREFERRED EMBODIMENTS

A high pressure pump 2 causes water to be pumped through the three way valve 4 and into an inlet chamber consisting of a tubular inlet portion 3 and cage 8 comprising a cylindrical chamber. The high pressure of the water entering the fluid pressure pulse generator 1 causes a movable body which is preferably a ball 7 to be shifted abruptly to the right to be seated within valve seat 13 having an annular configuration. An annular passageway 9 is produced because the diameter of the ball 7 is less than the diameter of the cylindrical cage 8 which produces an annular passageway having a width of about 10 mils. This passageway 9 enables the water to flow around ball 7 and into the annular accumulator chamber 5 until the pressure therein is very high, typically in the neighborhood of 400 megapascals or about 60,000 psi. Conventional three way valve 4 is thereafter actuated in the direction indicated by arrow 8 to cause the inlet chamber 3 to communicate with the atmosphere, to permit the high pressure within the pulse generator 1 to be vented t the atmosphere, as indicated by arrow 14. This action causes ball 7 to be abruptly shifted to the left, from its first position seated within the annular valve seat 13, to a second position away from seat 13, thereby enabling a high pressure pulse to pass into the outlet chamber or tube 11. Since the annular passageway has a width of only about 10 mils, only a small percentage of the pressure is lost due to the limited backflow of the high pressure water within accumulator 5 into the inlet tube 3. This impulse is transmitted into bore hole 20 formed within concrete or rock formation 22 thereby to cause fracturing or fragmentation of the rock. A second high pressure impulse may be readily produced by again actuating conventional three way valve 4 to again couple the high pressure pump 2 to the inlet chamber 3 to cause the ball 7 to be abruptly shifted from the second position away from valve seat 13 into the first position against the valve seat, thereby to repeat the aforesaid process of building up pressure in the annular accumulator 5.

It should now be appreciated that the method of the invention involves the utilization of a novel fluid pressure pulse generator having a single moving part to enhance reliability, and which eliminates the need for the above mentioned ruptured disks, to in turn enable the repeated actuation of the inlet valve 4 to produce a rapid stream of very high pressure pulses introduced into bore hole 20. The cylindrical cage 8 of the input chamber together with the movable ball 7 and its annular valve seat 13 comprises a check valve which has only one moving part rather than additional parts such as springs and the like to enhance reliability.

While there has been described what is at present considered to be the preferred embodiment of this invention, it will be obvious to those skilled in the art that various changes and modifications may be made therein without departing from the invention and it is, therefore, intended in the appended claims to cover all such changes and modifications as fall within the true spirit and scope of the invention, including art recognized equivalents. For example, the term "rock" as used in the claims is intended to include other masses such as concrete and the like which require demolition through the use of the high pressure fluid pulses. Water is the preferred fluid, but it is within the scope of the invention to include other fluids. While movable body 7 is preferably a ball, other shapes such as a cylinder having a tapered nose may be utilized.

What is claimed is:

1. Method of producing a very high fluid pressure pulse comprising the steps of:

(a) providing a fluid pressure pulse generator having a fluid inlet chamber communicating with an accumulator via a movable body positioned within said inlet chamber, a narrow fluid passageway bypassing said movable body, an outlet chamber coupled to a valve seat means for preventing communication between said outlet chamber and said accumulator when said movable body assumes a first position against said valve seat means and for permitting said outlet chamber to communicate with said accumulator when said movable body is separated from said valve seat means when said movable body assumes a second position;

(b) introducing fluid within said fluid inlet chamber for causing said movable body to assume said first position and for also causing said fluid to flow through said passageway into said accumulator until fluid pressure therein is very high; and (c) thereafter rapidly reducing fluid pressure within said inlet chamber to cause said movable body to assume said second position for in turn causing high impulse ejection of fluid from said accumulator into said outlet chamber.

2. The method of claim 1 wherein water is introduced into said inlet chamber to fill said accumulator during the performance of step (b).

3. The method of claim 1 wherein said fluid is introduced into said accumulator until the pressure therein reaches about 60000 psi or more.

4. The method of claim 2 wherein said fluid is introduced into said accumulator until the pressure therein reaches about 60,000 psi or more.

5. The method of claim 1 wherein said movable body consists essentially of a ball, loosely fitted within said inlet chamber to form said fluid passageway and positioned against said valve seat means during the performance of step (b).

6. The method of claim 2 wherein said movable body consists essentially of a ball, loosely fitted within said inlet chamber to form said fluid passageway and positioned against said valve seat means during the performance of step (b).

7. The method of claim 3 wherein said movable body consists essentially of a ball, loosely fitted within said inlet chamber to form said fluid passageway and positioned against said valve seat means during the performance of step (b).

8. The method of claim 4 wherein said movable body consists essentially of a ball, loosely fitted within said inlet chamber to form said fluid passageway and positioned against said valve seat means during the performance of step (b).

9. The method of claim 2 wherein fluid flows through said passageway having a width of about ten mils during the performance of step (b).

10. The method of claim 4 wherein fluid flows through said passageway having a width of about ten mils during the performance of step (b).

11. The method of claim 6 wherein fluid flows through said passageway having a width of about ten mils during the performance of step (b).

12. The method of claim 7 wherein fluid flows through said passageway having a width of about ten mils during the performance of step (b).

13. The method of claim 1 further including the step of introducing said high impulse ejection of fluid within a rock formation for shattering said rock formation.

14. The method of claim 2 further including the step of introducing said high impulse ejection of fluid within a rock formation for shattering said rock formation.

15. The method of claim 5 further including the step of introducing said high impulse ejection of fluid within a rock formation for shattering said rock formation.

16. The method of claim 9 further including the step of introducing said high impulse ejection of fluid within a rock formation for shattering said rock formation.

17. The method of claim 12 further including the step of introducing said high impulse ejection of fluid within a rock formation for shattering said rock formation.

18. The method of claim 1 wherein step (c) is carried out by venting said inlet chamber to the atmosphere.

19. The method of claim 4 wherein step (c) is carried out by venting said inlet chamber to the atmosphere.

20. The method of claim 5 wherein step (c) is carried out by venting said inlet chamber to the atmosphere.

21. Method of producing a very high fluid pressure pulse comprising the steps of:

(a) providing a fluid pressure pulse generator having a fluid inlet chamber communicating with an accumulator via a check valve consisting essentially of a springless, single movable body loosely positioned within said inlet chamber to form a narrow fluid passageway bypassing said movable body, an outlet chamber coupled to a valve seat means for preventing communication between said outlet chamber and said accumulator when said movable body assumes a first position against said valve seat means and for permitting said outlet chamber to communicate with said accumulator when said movable body is separated from said valve seat means when said movable body assumes a second position;

(b) introducing fluid within said fluid inlet chamber for causing said movable body to assume said first position and for also causing said fluid to flow through said passageway into said accumulator until fluid pressure therein is very high; and (c) thereafter rapidly reducing fluid pressure within said inlet chamber to cause said movable body to assume said second position for in turn causing high impulse ejection of fluid from said accumulator into said outlet chamber.

22. The method of claim 21 wherein said movable body consists essentially of a ball, loosely fitted within said inlet chamber to form said fluid passageway and positioned against said valve seat means during the performance of step (b).

23. The method of claim 22 wherein water is introduced into said inlet chamber to fill said accumulator during the performance of step (b).

24. The method of claim 21 wherein said passageway has a width of about ten mils.

25. The method of claim 22 wherein said passageway has a width of about ten mils.

* * * * *